US006095213A

United States Patent [19]

Roegner

[11] Patent Number: 6,095,213

[45] **Date of Patent: *Aug. 1, 2000**

[54] PURSE ORGANIZER AND CARRYING CASE

[76] Inventor: DeAnna Roegner, 774 Mays Blvd. #10-405, Incline Village, Nev. 89451

[ * ] Notice: This patent is subject to a terminal disclaimer.

[21] Appl. No.: 09/229,241

[22] Filed: Jan. 12, 1999

Related U.S. Application Data

[63] Continuation-in-part of application No. 08/886,719, Jul. 1, 1997, Pat. No. 5,865,233.

[51] Int. Cl.[7] ..... A45C 11/26; A45C 15/04

[52] U.S. Cl. ..... 150/106; 150/104; 150/113; 190/110

[58] Field of Search ..... 150/106, 117; 383/39; 190/109, 110

[56] References Cited

U.S. PATENT DOCUMENTS

| | | | |
|---|---|---|---|
| 1,705,149 | 3/1929 | Brady | 190/901 X |
| 1,915,007 | 6/1933 | Weiss | 190/901 X |
| 2,038,319 | 4/1936 | Stanley | 132/79 |
| 2,092,834 | 9/1937 | Doppelt | 132/79 |
| 2,167,926 | 8/1939 | Glasker | 132/79 |
| 2,183,428 | 12/1939 | McNary | 150/113 X |
| 2,299,673 | 10/1942 | Zolkind | 120/1 |
| 2,359,100 | 9/1944 | Florin | 190/901 X |
| 2,413,465 | 12/1946 | Ohlsen | 150/118 X |
| 2,464,312 | 3/1949 | Holden | 150/113 |
| 2,554,215 | 5/1951 | Schell et al. | 190/901 X |
| 2,612,199 | 9/1952 | Schocket | 150/111 X |
| 2,899,999 | 8/1959 | Dobbs et al. | 150/113 X |
| 2,937,728 | 5/1960 | Koffler | 190/110 |
| 3,137,374 | 6/1964 | Holtzman | 190/110 |
| 3,831,651 | 8/1974 | Leahy | 150/106 |
| 4,161,201 | 7/1979 | Carp | 190/110 |
| 4,386,642 | 6/1983 | Durbin | 190/110 |
| 4,424,841 | 1/1984 | Smith | 190/110 X |
| 4,580,667 | 4/1986 | Herwood | 190/110 |
| 4,782,874 | 11/1988 | Chartier | 150/117 X |
| 4,852,293 | 8/1989 | Levine et al. | 190/110 X |
| 5,052,555 | 10/1991 | Harmon | 206/315.11 |
| 5,238,305 | 8/1993 | Feller | 383/39 X |
| 5,350,045 | 9/1994 | Robertson | 190/110 |
| 5,706,935 | 1/1998 | Lorton | 150/117 X |
| 5,829,502 | 11/1998 | Distefano et al. | 190/110 X |
| 5,865,233 | 2/1999 | Roegner | 150/106 X |

FOREIGN PATENT DOCUMENTS

| | | | |
|---|---|---|---|
| 2636510 | 3/1990 | France | 150/106 |
| 709828 | 8/1941 | Germany | 150/118 |

*Primary Examiner*—Sue A. Weaver
*Attorney, Agent, or Firm*—Baker & Maxham

[57] ABSTRACT

An organizing case for articles that can be carried as a clutch, or small shoulder bag, or in a purse. The carrying case comprises a generally rectangular primary panel having an inner and an outer face that is folded along a selected transverse line forming a front panel and a back panel with the inner face defining a primary receptacle. A pocket assembly and an inner mounting panel—having a mirror mounted on one face, and a plurality of attachment devices for detachably mounting a plurality of items—are pivotally mounted inside the primary receptacle. A removable cover—stowable in the case—is shaped to envelop the case so that the case can be carried as a purse.

26 Claims, 10 Drawing Sheets

PURSE ORGANIZER AND CARRYING CASE

REFERENCE TO RELATED APPLICATION

This is a continuation-in-part of application Ser. No. 08/886,719 filed Jul. 1, 1997, entitled PURSE ORGANIZER, now allowed as U.S. Pat. No. 5,865,233.

BACKGROUND OF THE INVENTION

The present invention relates to article carrying cases and pertains particularly to an improved organizing case having an improved arrangement of multiple pockets and mounting panels for holding multiple personal articles in an organized fashion for carrying in a purse.

Many ladies have many items of makeup which they commonly carry in their purse. These items are often placed loosely in the purse among other articles. This often leaves the items disorganized, sometimes tangled and often difficult to easily locate and retrieve.

In my above identified parent application I disclose a purse organizer that solved many of the problems of the prior art. However, I have discovered the need for additional improvements. One improvement which I conceived is the provision of means for conversion of the organizer to an appealing clutch—a small strapless handbag—or shoulder bag for convenient carrying of items separate from other personal articles. Another improvement is a modification to provide a zipper closure around the periphery of the purse organizer.

There exists a need for a purse organizing case that is adaptable to mount or hold many different related or unrelated personal items in an organized fashion within a purse that can be convertible to an attractive clutch, or shoulder bag. It would be desirable to have a purse organizer with multiple holding or mounting panels and pockets for holding many different related articles and unrelated articles for ease of location and retrieval that can be quickly converted into a separate vanity bag or clutch.

SUMMARY AND OBJECTS OF THE INVENTION

One object of the present invention is to solve the problem of keeping personal articles of different sizes and shapes organized and secure. Broadly, the invention provides an organizing case with multiple pockets and attachment means for holding articles of different sizes secure and readily accessible in an organized arrangement. The invention can be carried in a purse, or carried alone as a clutch, or as a small shoulder bag.

More specifically, the invention may be implemented as a device having a generally rectangular exterior primary panel having an inner face and an outer face and foldable along a line that is generally parallel to a short side of the rectangle forming a front and back panel with the inner face defining a primary receptacle. A pocket assembly and an inner mounting panel—having a mirror mounted on one side and a plurality of attachment means mounted on the other side to detachably mount a plurality of items—are pivotally mounted to the primary panel. A removable cover—stowable in the case—is shaped to envelop the case so that the case can be carried as a purse.

However, the claims alone—not the preceding summary—define the invention.

BRIEF DESCRIPTION OF THE DRAWINGS

The nature, goals, and advantages of the invention will become more apparent to those skilled in the art after considering the following detailed description when read in connection with the accompanying drawings—illustrating by way of examples the principles of the invention—in which like reference numerals identify like elements throughout, wherein.

DETAILED DESCRIPTION OF THE PREFERRED EMBODIMENTS

The present invention provides an organizing case with multiple pockets and attachment means for holding articles of different sizes secure and readily accessible in an organized arrangement. The invention can be carried in a purse, or carried alone as a clutch, or as a small shoulder bag.

Figure 1:
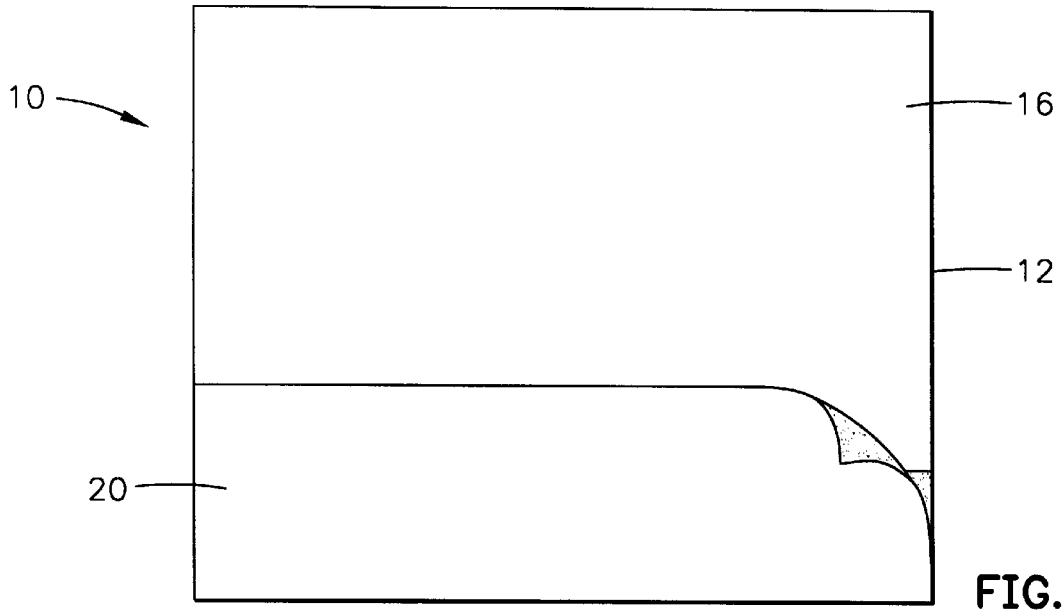
FIG. 1 is a front elevation view of an exemplary preferred embodiment of the invention with the case closed.
Figure 2:
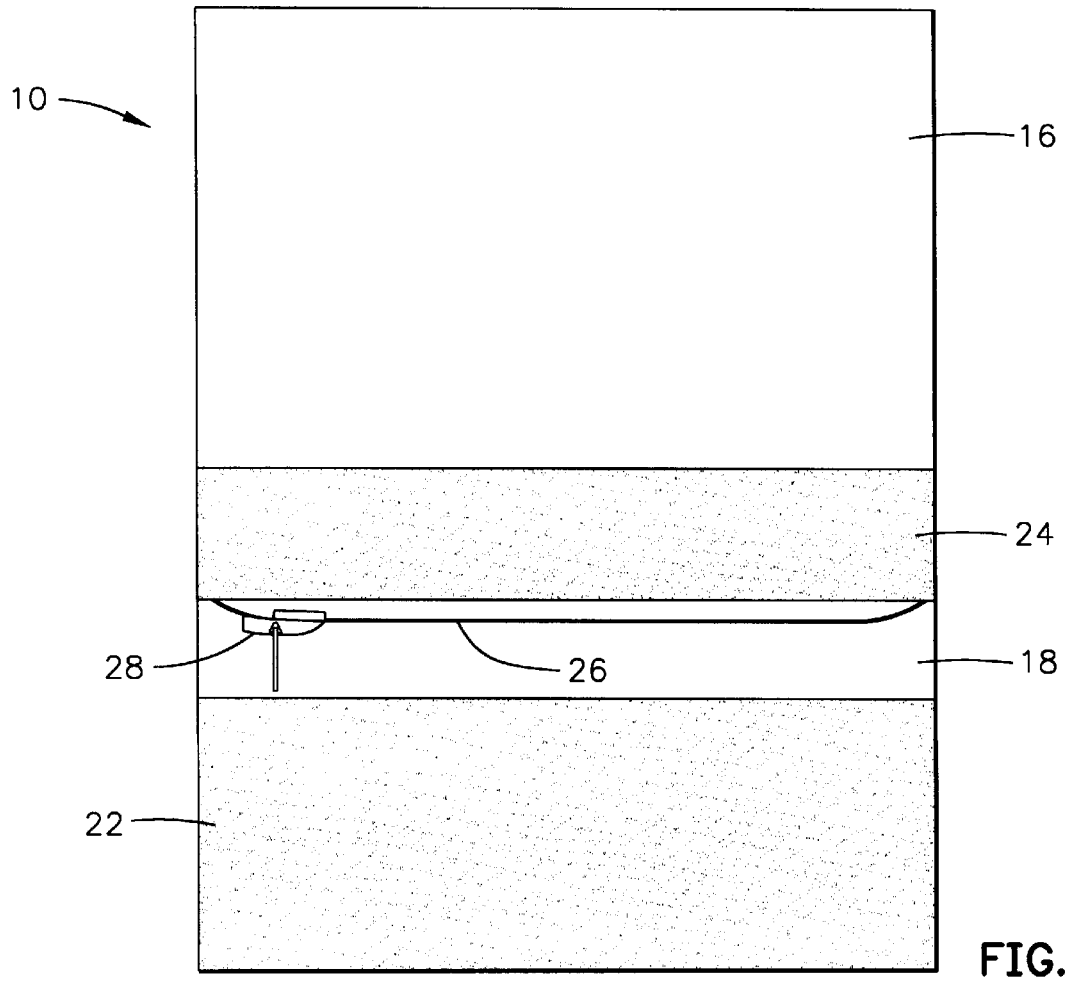
FIG. 2 is a view like FIG. 1 with the case closure flap open.

Referring to FIGS. 1 and 2 of the drawing, the organizing case in accordance with the invention is illustrated and designated generally by the numeral 10. The case is preferably constructed of a pliable material, either natural—such as leather, velvet, or cotton or any other suitable material—or a synthetic—such as nylon, rayon, vinyl, polyester or any other suitable material. The case comprises a primary support and closure panel or shell formed of a unitary elongated substantially rectangular panel 12 having inner and outer faces and foldable along a transverse line 14 forming an upper or back panel 16 and lower or front panel 18 defining a primary receptacle.

The primary support panel as shown in the illustrated embodiment comprises an elongated generally rectangular cover panel having an upper end and a lower end with a closure flap 20 having suitable fastening means such as hook and loop fastening means 22 for cooperatively engaging hook and loop fastening means 24 on the upper back of the upper panel 16. The upper or back panel of the primary panel is provided on its outer surface with a outer or back pocket having an opening with closure means such as a zipper 26 having a slider 28. The pocket is formed in the usual manner of opposing rectangular panels secured along three sides like an envelope leaving the opening along one side. One panel of the pocket may include a portion of the primary panel. The pocket is accessible by peeling back closure panel or flap 20 as seen in FIG. 2. The back panel can then be flipped up so that the opening of the outer pocket is at the top for easy access as seen in FIG. 3.

Figure 3:
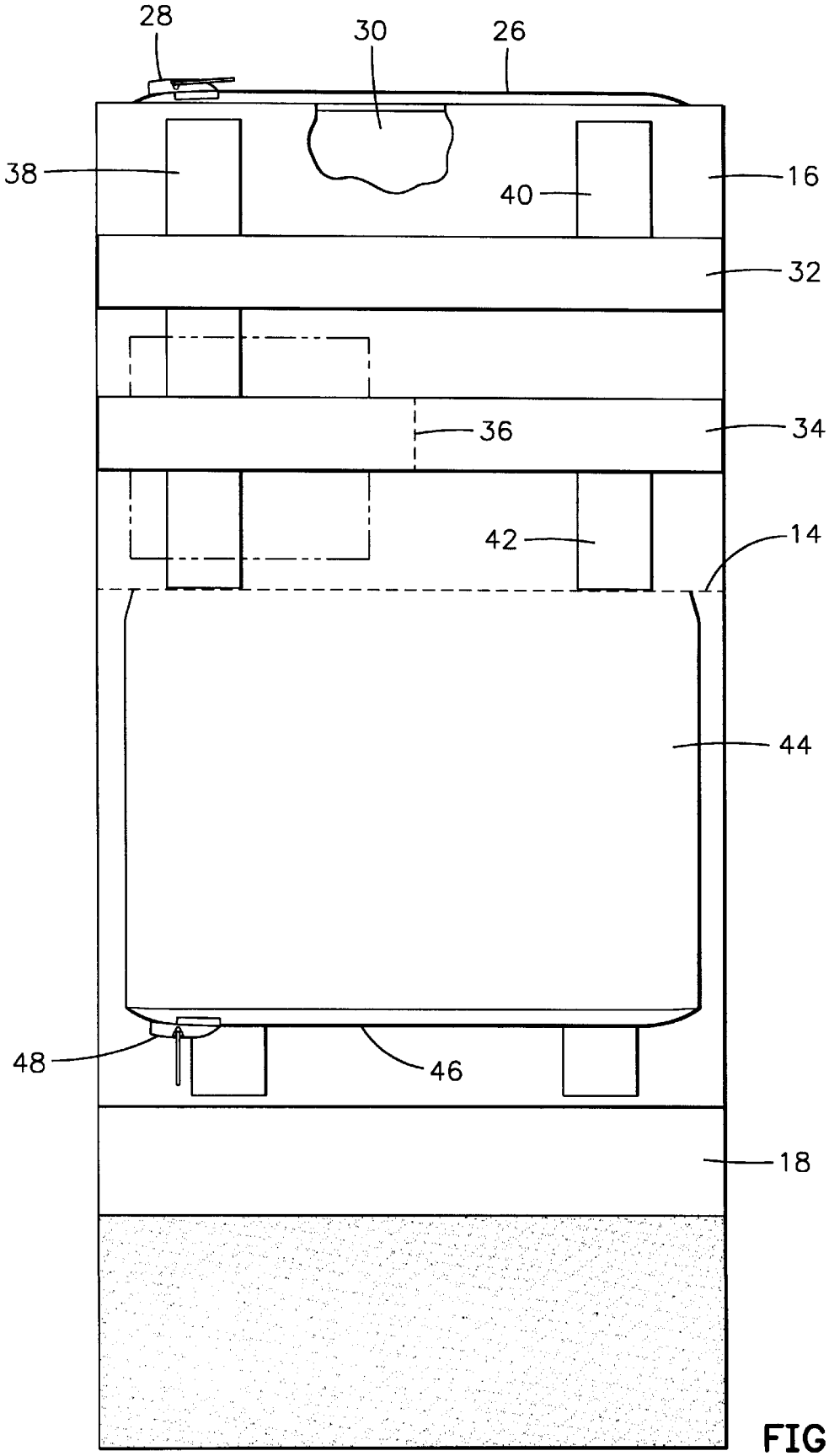
FIG. 3 is a front elevation view of the invention of FIG. 1 with the case shown in its open position.

The upper or back panel 16 of the primary panel is also provided with a stiffener 30 such as a cardboard, plastic or any other suitable material sandwiched between opposing pliable fabric panels separate from and interior of the back pocket as seen in FIG. 3. The outermost of these panels lies adjacent the inner panel of the pocket and forms a second pocket not having a separate closure. This pocket (not shown) is suitable for receipt and holding of business cards and the like.

The upper or back panel is also provided on its inner surface with multiple attachment means for separately detachably attaching a plurality of individual articles. The attachment means in the illustrated embodiment is constructed of a plurality of elastic bands attached to the face of the back panel forming loops. A pair of horizontal elastic straps, or bands 32 and 34 are attached at their ends to the back panel, each forming what can be termed a loop for the attachment of articles. The band 34 is also secured intermediate its ends at 36 to the back panel to form two loops.

Multiple elastic bands 38, 40 and 42 are attached vertically to opposite side edges of the back panel forming multiple loops for detachably attaching articles in place on the face of the back panel. The bands are attached at their ends to the back panel and may also be attached at points in between to form multiple loops. These bands or loops can hold any number and size of articles such as small compacts, tubes of lipstick, and other similar articles.

Referring now to FIG. 3, an inner pocket assembly 44 is illustrated and pivotally secured about on line 14 to the primary panel. The pocket assembly is formed of an envelope-type structure with front and back panels secured along side and bottom edges to form a pocket with an opening at the top. The opening is provided with a suitable closure such as a zipper 46 with slider 48 at the upper edge over the opening to close the pocket. The pocket may be made out of any suitable fabric or other suitable pliable material, as described above.

Figure 4:
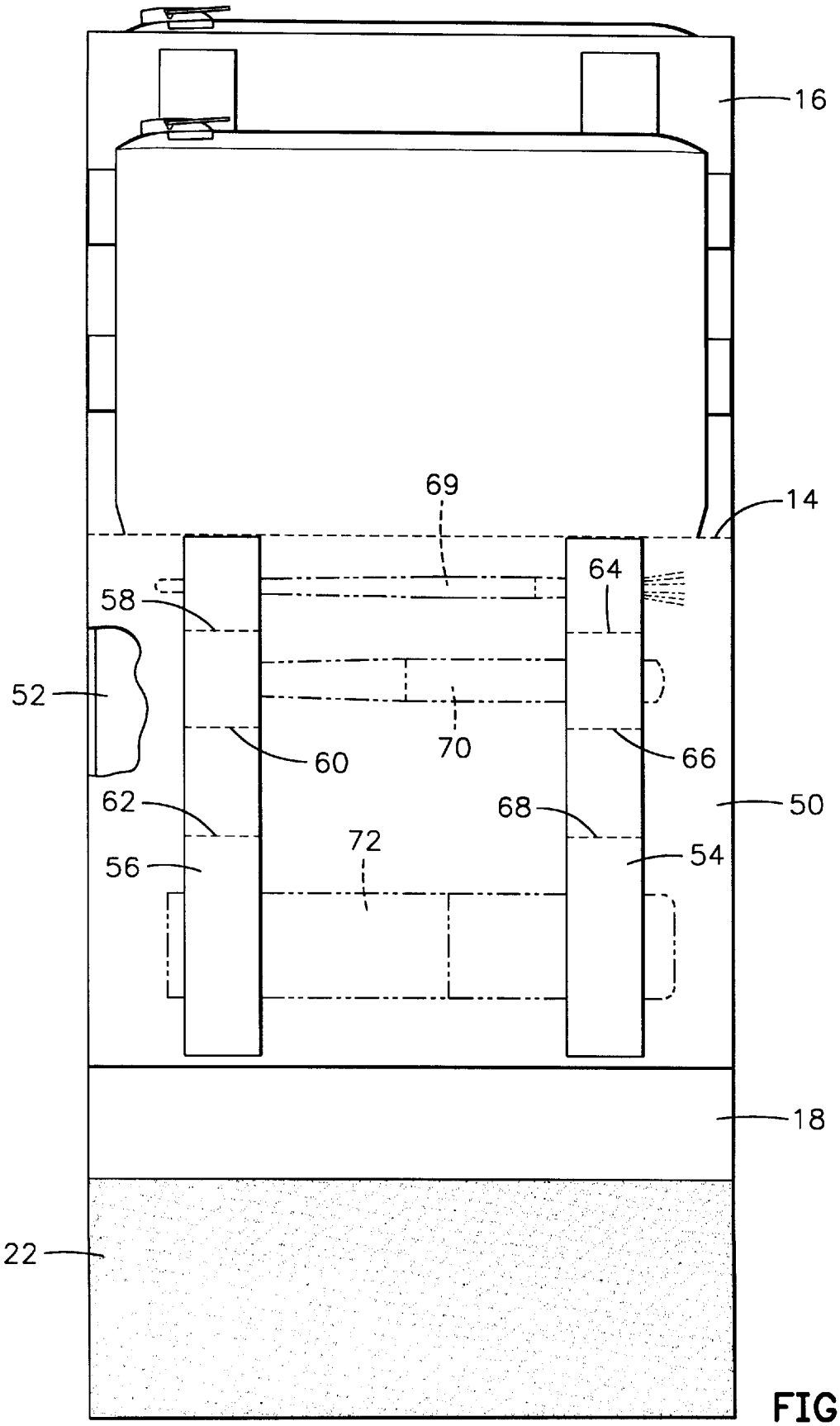
FIG. 4 is a view like FIG. 1 with the case open showing the inside construction with the inside pocket pivoted upward.

This organizing case may have any number of the pocket assemblies from 1 or 2 or more, if desired. The case is designed to easily place in a purse for ease of assembling and holding articles or the like, to provide easy access. The pockets are suitable for holding any number and kind of small articles. They may also serve as a coin purse. Referring to FIG. 4, a mounting panel 50 is provided and mounted for pivoting along line 14. This panel is provided with an interior stiffening panel 52—made of cardboard, plastic or any other suitable material—for better support. A pair of bands 54 and 56 extend in spaced vertical relation on one or a top face of the panel. These bands are attached at the ends to the panel and are each secured at positions 58, 60, 62, 64, 66, and 68 respectively to the panel to provide multiple loops for securing multiple articles 69, 70, and 72 to the face of the panel.

Figure 5:
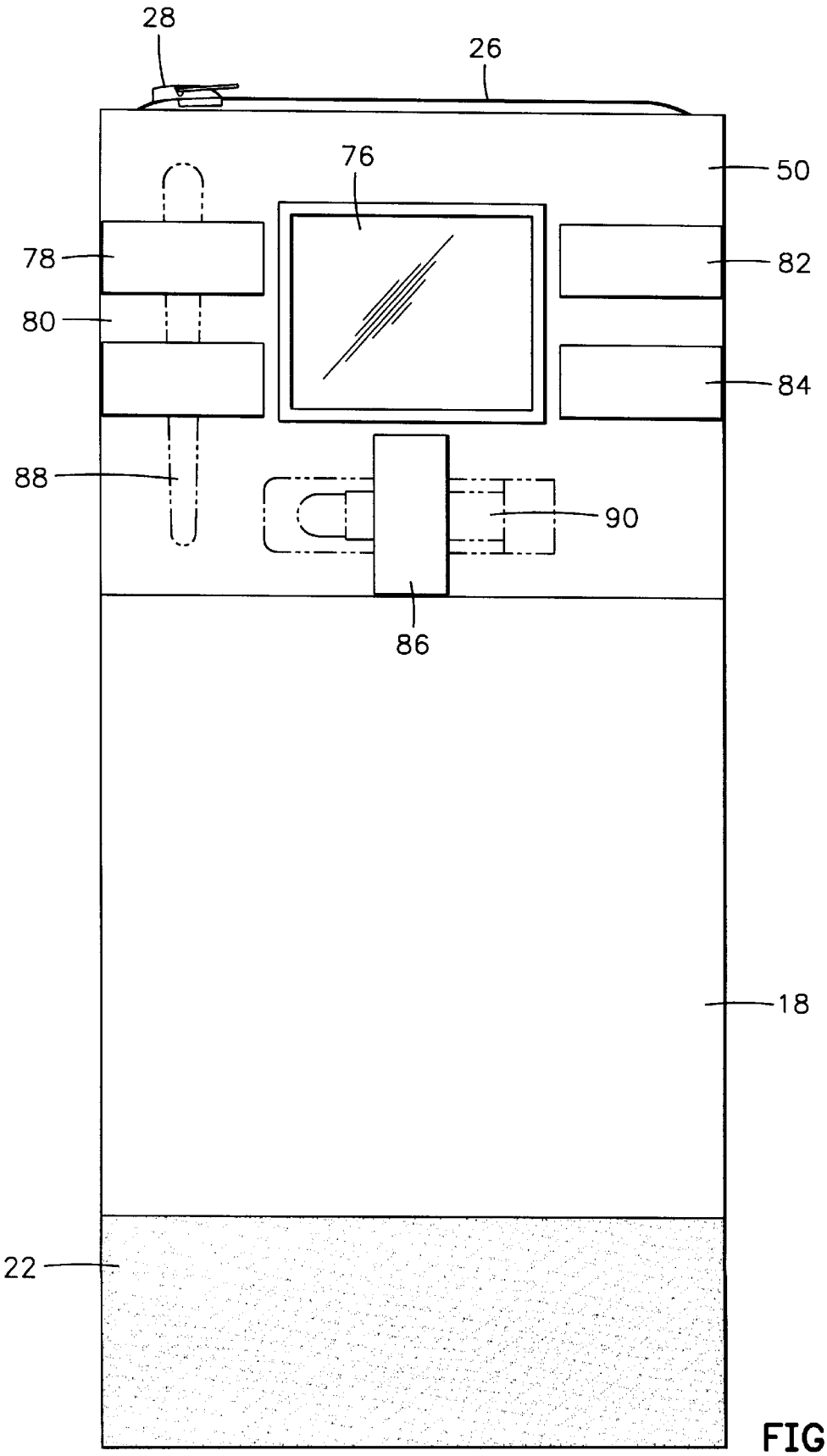
FIG. 5 is a view like FIG. 4 with the internal mounting panel folded upward.

Referring to FIG. 5, the mounting panel 50 is pivoted upward to reveal the opposite side or bottom face. A mirror 76 is mounted in the center of this face of the support panel. A pair of elastic bands 78 and 80 are mounted on one side or the mirror, and a pair of bands 82 and 84 are mounted on the other side. A band 86 is mounted below the mirror. These may mount any number of different items such as a fingernail file shown in phantom at 88 and a tube of lipstick shown in phantom at 90. Any suitable arrangement of the bands may be made on any of the support panels. The mirror may also be mounted in any suitable position on any of the panels.

Figure 6:
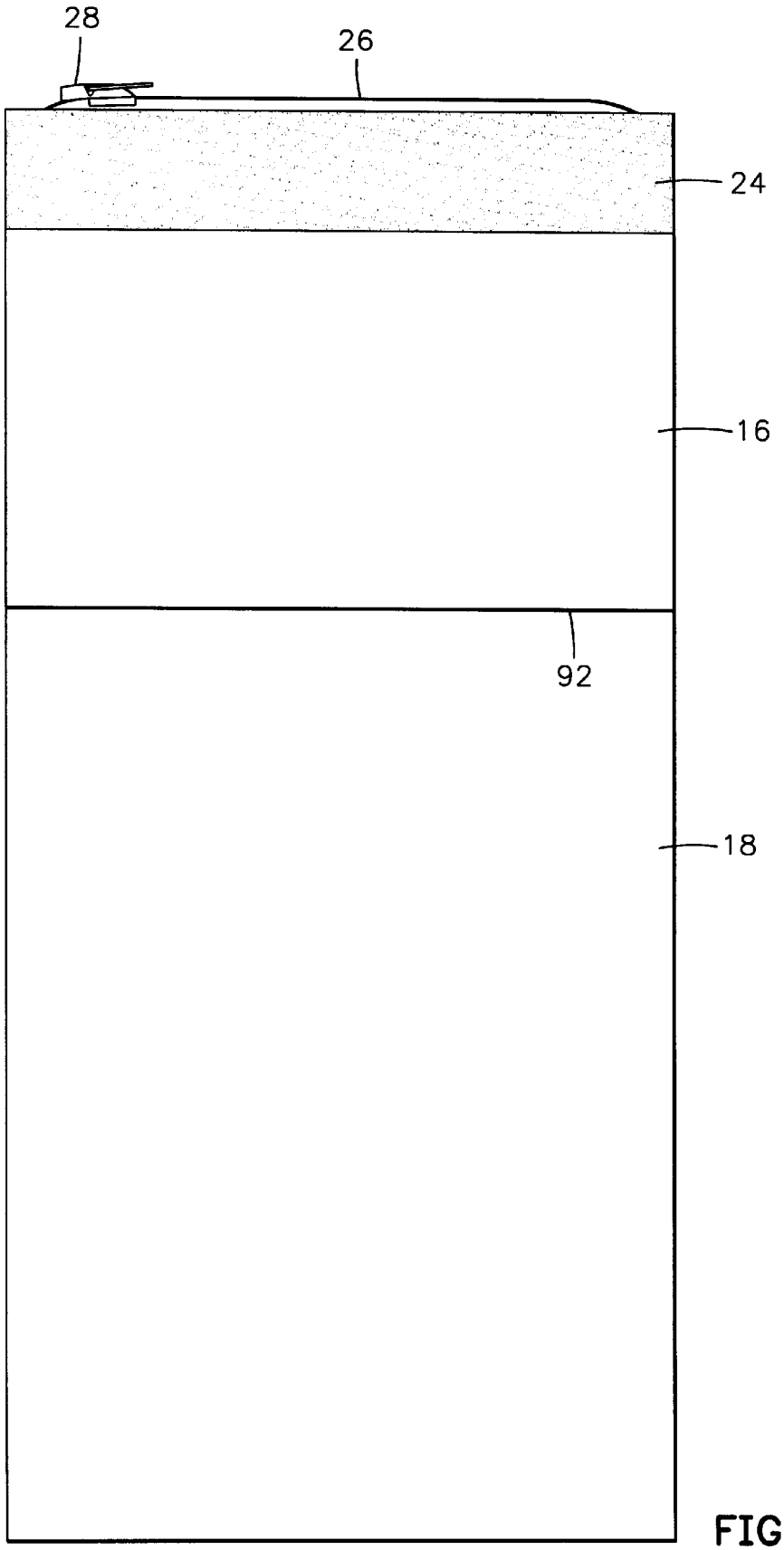
FIG. 6 is a back elevation view of the outside of the case with the case open.
Figure 7:
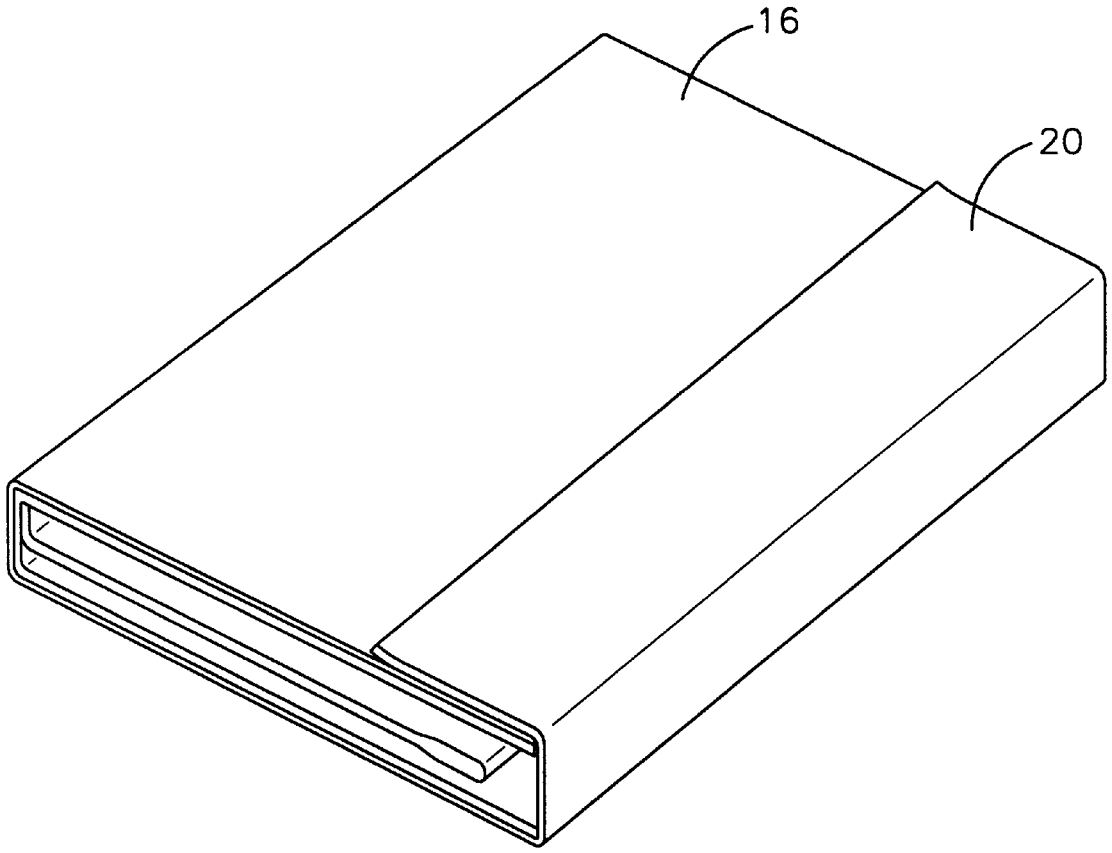
FIG. 7 is a perspective view showing the case closed from the front and above.

The front panel is primarily a cover and closure that hangs down as seen in FIGS. 5 and 6 to provide access to the interior thereof. It extends from the bottom edge 92 of back panel 16 and wraps over and encloses the entire interior of the organizing case and secures it closed as shown in FIG. 7.

Figure 8:
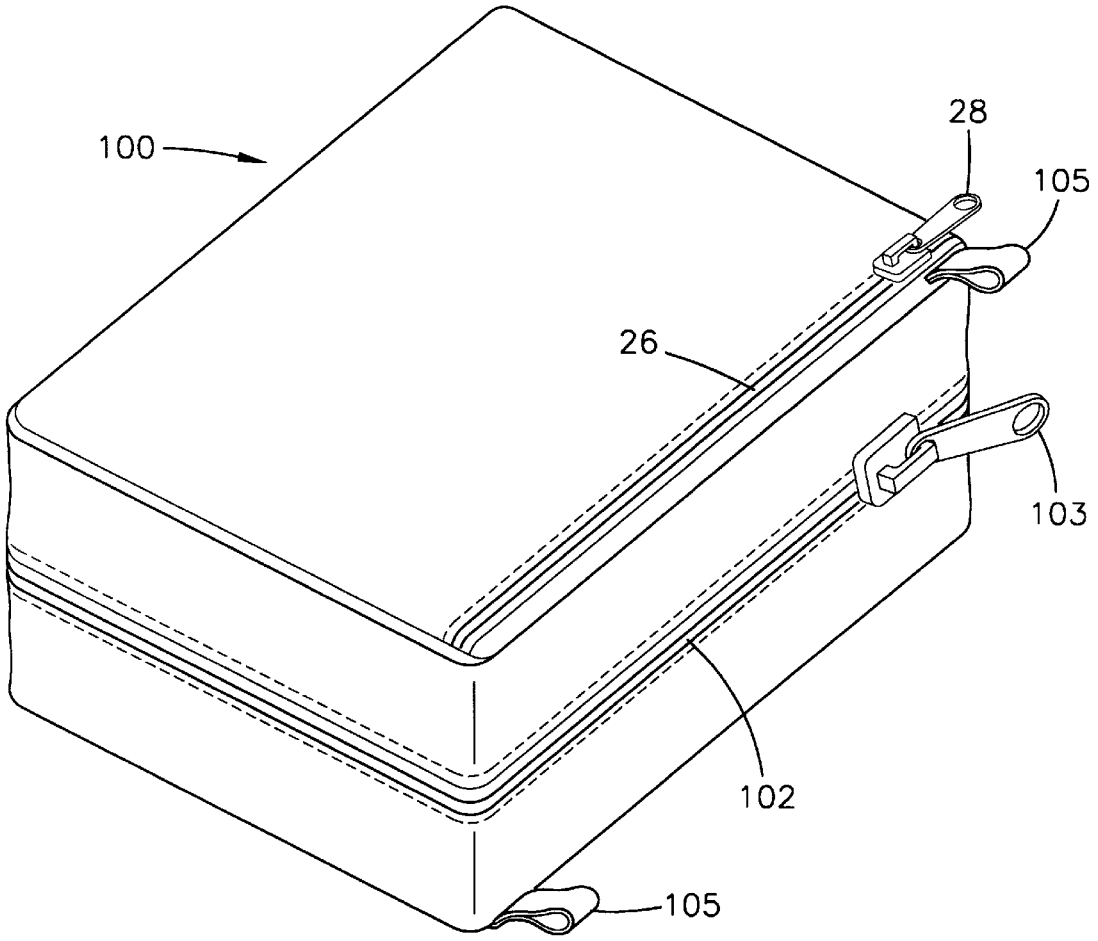
FIG. 8 is a perspective view of an alternate embodiment of the invention—a clutch closed from the front and above.

Referring to FIG. 8, an alternate embodiment clutch 100 is illustrated wherein the clutch is provided with a peripheral closure such as a zipper 102 having a slider 103. Also shown is the exterior pocket (also seen in FIG. 2) having zipper closure 26 that uses a slider 28. Because the clutch has a zipper closure, the closure flap 20 (shown in FIG. 1) is not necessary. Also, the hook and loop fastening means 22 that engage with hook and loop fastening means 24 are also not necessary. Furthermore, in some examples, the front panel 18 and back panel 16 can be rigid, or semi-rigid by use of a stiffener such as cardboard or plastic, as described above for the back panel of the case 10.

Figure 9:
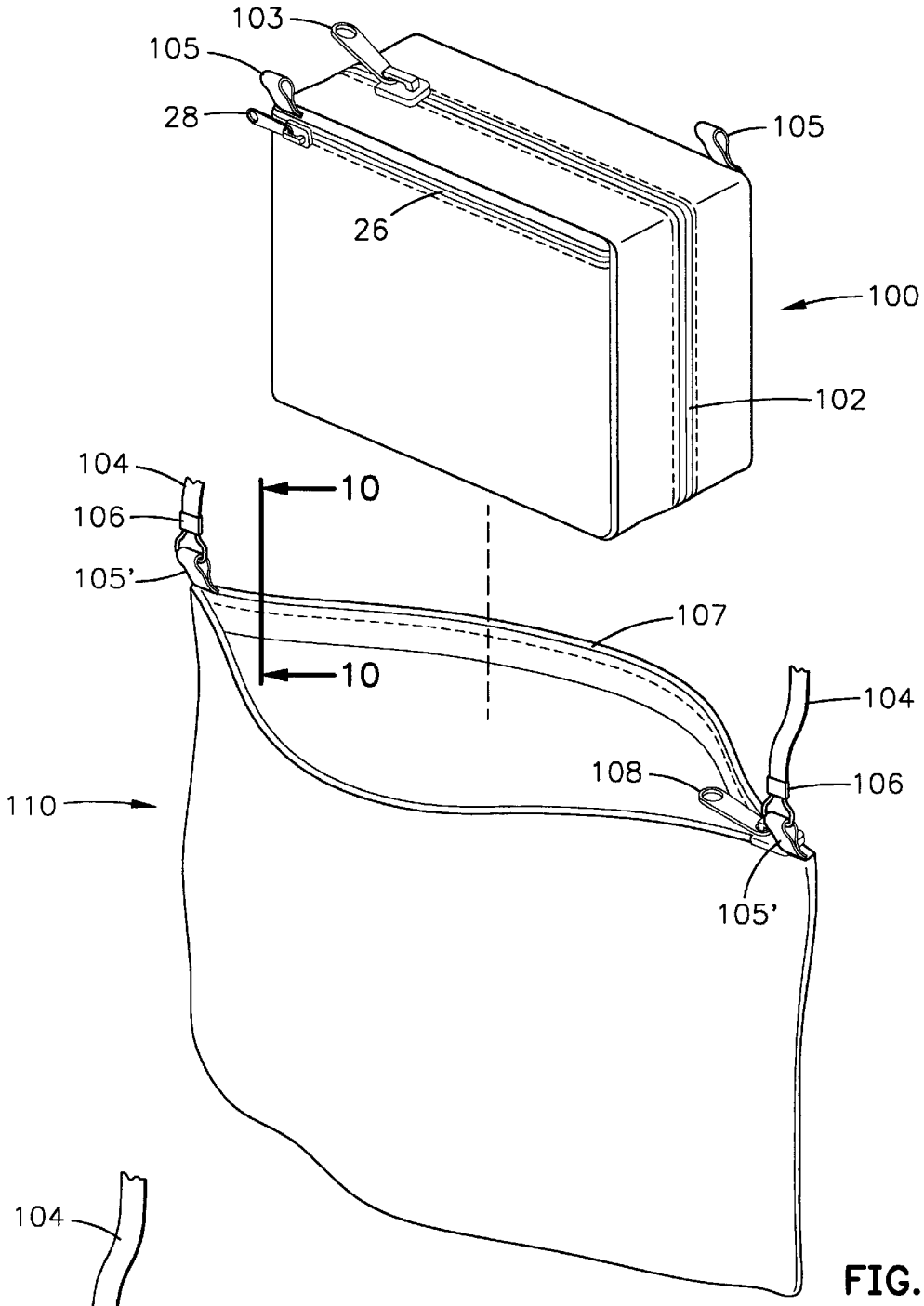
FIG. 9 is a perspective view of the clutch of FIG. 8, positioned above a shroud.
Figure 10:
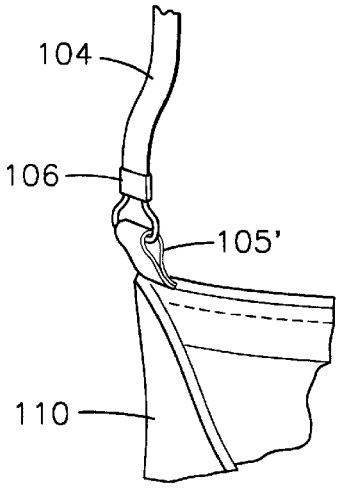
FIG. 10 is an detail elevation view of a clip attached to an anchor on the clutch of FIG. 8.

Because the clutch can carry most of the essential contents of a purse, it can on many occasions be removed from the purse and carried as a purse or handbag, as shown in FIGS. 8 and 9. The clutch can be grasped in the hand—like a handbag—or a tether or strap, 104 can be attached to each strap anchor 105, and the clutch can be carried like a shoulder bag or purse, with the strap positioned over the shoulder. As shown in FIG. 10, the strap has a hook, or clip 106 positioned at each end of the strap that permits the strap to be quickly attached to or separated from the strap anchors.

Again referring to FIG. 9, the clutch 100 can be placed in a cover or shroud 110. The shroud encases the clutch and protects the clutch from the elements. Also, the shroud changes the appearance of the clutch, as the shroud can be made from many different materials—like leather, velvet, silk, cotton or synthetics—and have many different patterns or surface designs—such as sequins or flowers. The shroud can be closed with a zipper 107 and slider 108, or with hook and loop fastening means, or with buttons (not shown). The strap 104 can either be sewn or otherwise directly attached to the shroud, or the strap can employ clips 106 that engage anchors 105 on the shroud—shown in FIG. 9—permitting easy detachment of the strap from the shroud, and permitting the strap to be interchangeable between the clutch and the shroud. The shroud 110 and strap 104 can be carried inside the clutch—in one of the pockets, or mesh pouches—or preferably in the exterior pocket.

Figure 11:
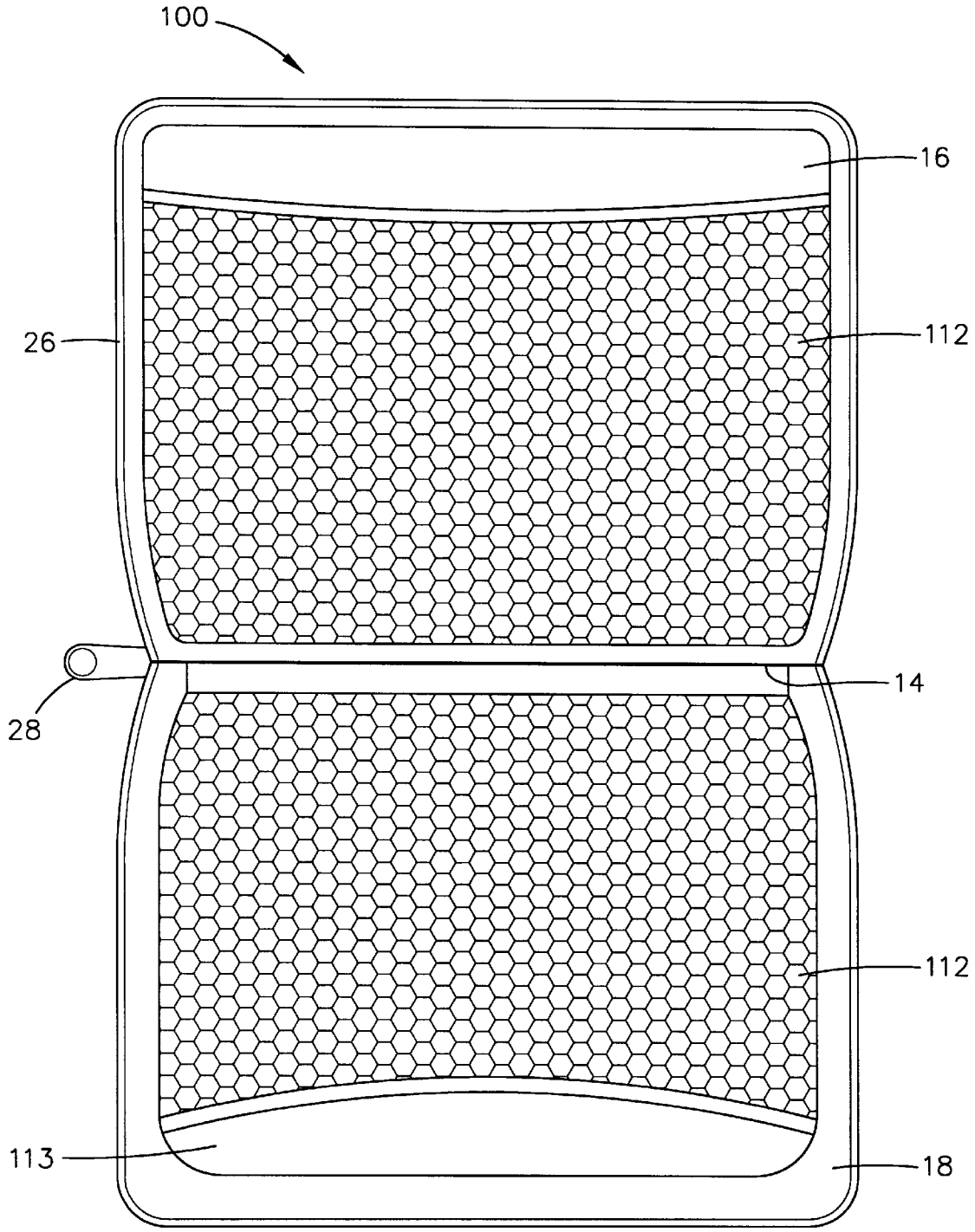
FIG. 11 is an elevation view of the clutch of FIG. 8 open, showing the inner back panel and one side of a rigid panel.

The interior of a preferred embodiment clutch 100 is similar to the interior of the preferred embodiment case 10—but with the addition of more devices to carry more items. As shown in FIG. 11, a mesh pocket, or pouch 112 is located on the inner surface of the back panel 16 of the primary panel 12. A similar mesh pouch is located on the inner surface of the front panel 18 of the primary panel (not shown). Both of the mesh pouches are formed in the usual manner by securing the mesh along three sides like an envelope leaving the opening along one side. The mesh is preferably made of an elastic synthetic material such as nylon—but can also be made from natural materials. The advantage of a mesh pouch is that small items can be securely held, and also be completely visible.

Again referring to FIG. 11, a first rigid, or semi-rigid panel 113 is illustrated and pivotally secured about line 14 to the primary panel. As described above regarding the back panel 16 of the case 10, the rigid panel 113 is provided with an internal stiffener. Located on one side of the rigid panel is another mesh pouch 112. The mesh pouch is formed in the usual manner by securing the mesh along three sides like an envelope leaving the opening along one side. The advantage of a mesh pouch is that small items can be securely held, and also be completely visible. On the other side of the rigid panel 113 is an arrangement of elastic bands similar to that found on the inner surface of the back panel 16, shown in FIG. 3. As seen in FIG. 3, a pair of horizontal elastic bands, and a pair of vertical elastic bands—secured to the rigid panel—form a plurality of loops. These loops can hold a plurality of individual articles, of different sizes and shapes, such as small compacts, tubes of lipstick, and other similar articles.

Figure 12:
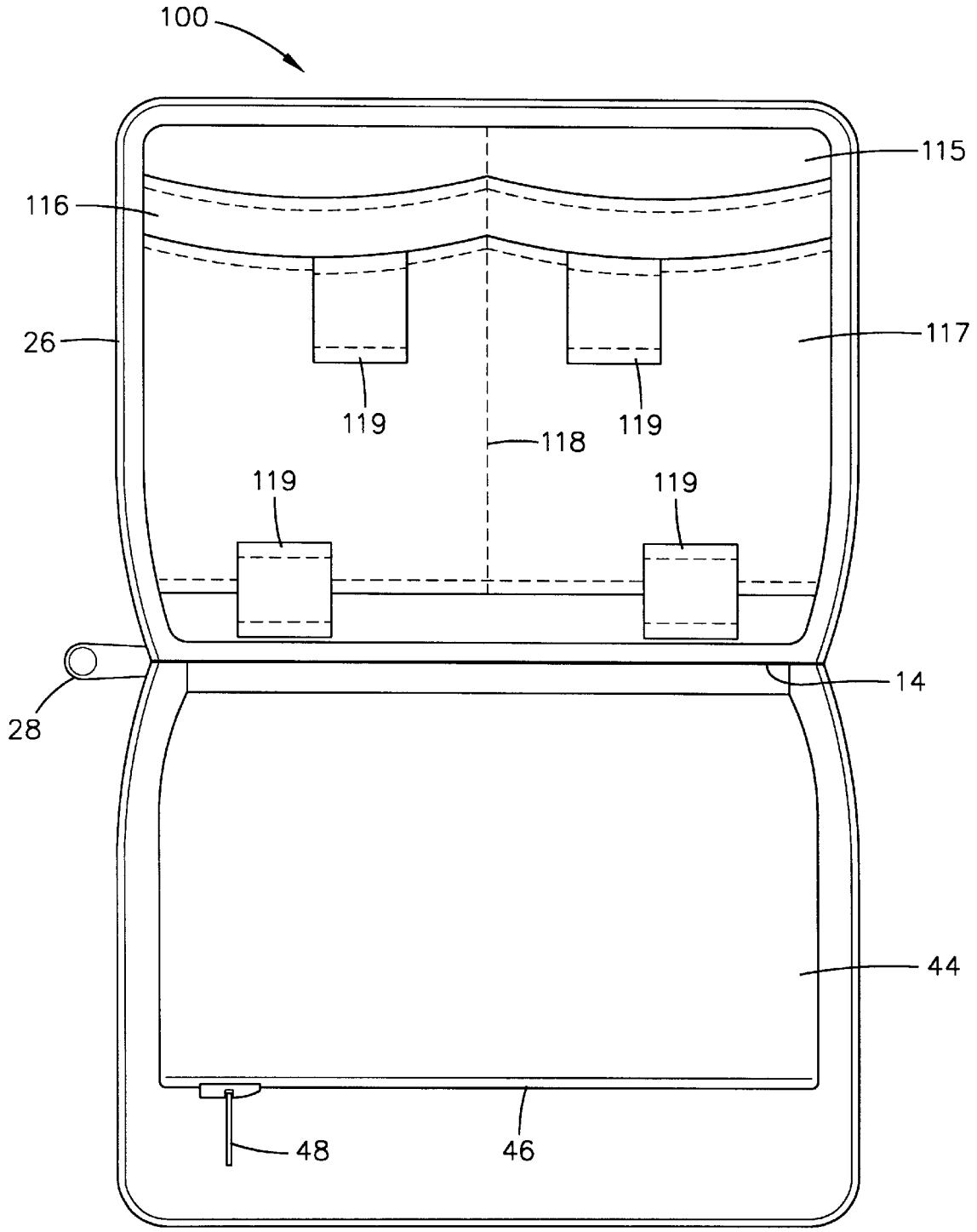
FIG. 12 is an elevation view of the clutch of FIG. 8 open, showing the other side of the rigid panel shown in FIG. 11, and an inner pocket assembly.

Now referring to FIG. 12, a second rigid, or semi-rigid panel 115 is illustrated and pivotally secured about line 14 to the primary panel. As described above regarding the first rigid panel 113, the second rigid panel 115 is provided with an internal stiffener. Located on one side of the rigid panel 115 is another mesh pouch 112 (not shown) mounted, and configured as described above regarding the mesh pouch on the rigid panel 113. On the other side of the second rigid panel 115 are two rows of pockets formed by a first ply, or sheet 116 and a second ply, or sheet 117. The two sheets are formed by securing the sheet material—of a synthetic or natural type, as described above—along three sides like an envelope leaving an opening along one side. In addition, both sheets are secured to the rigid panel 115 along vertical line 118, forming two pockets in each sheet, or a total of four pockets for both sheets. Sheet 117 is shorter than sheet 116, resulting in an offset, or staggered configuration, which facilitates easy access to the pockets of sheet 116. Attached to sheet 117 are four elastic bands of material that form four loops 119, with two loops positioned near the opening of the sheet pockets, and two positioned at the base of the rigid panel 115, near the pivot line 14. The loops can store individual items, or they can be used in pairs, to hold longer items.

A preferred embodiment clutch 100 would comprise: a front panel 18 having a mesh pouch 112; a first rigid panel 113; an inner pocket assembly 44; a mounting panel 50; a second rigid panel 115; a back panel 16 with a mesh pouch; an outer pocket; a shroud 110; and a strap 104. Other examples of a clutch 100 would have the various pockets and panels arranged in a different order, or a different number of pockets or panels would be included in the clutch. Another embodiment of a clutch 100 may have the various panels and pockets attached along the pivot line 14 by hook and loop fastening means, so that panels and pockets can be added or subtracted to suit individual needs.

Other Embodiments

While I have illustrated and described the invention by means of specific embodiments, it is to be understood that a latitude of modification, change and substitution is intended in the foregoing disclosure, and in some instances, some features of the invention will be employed without a corresponding use of other features.

Accordingly, it is appropriate that the following claims be construed broadly and in a manner consistent with the spirit and scope of the invention herein described.

What is claimed is:

1. An organizing case that can be selectively carried inside a purse or as a clutch, the organizing case comprising:

a generally rectangular primary panel having an inner face and an outer face and foldable along a line that is generally parallel to a short side of the rectangle, so that the primary panel forms a front panel and a back panel, and the inner face defines a primary receptacle;

a pocket assembly pivotally mounted to the primary panel and comprising a back pocket panel and a front pocket panel secured together along a bottom and two side edges to form a cavity, wherein the pocket assembly is closed along a top edge by closure means selected from the group consisting of zippers and hook and loop fastening means;

a first inner mounting panel pivotally mounted to the primary panel and having two opposite faces with a mirror mounted on a first face, and a plurality of attachment means mounted on a second face to detachably mount a plurality of items; and a removable cover normally stowable in the case and configured to envelop the organizing case for carrying the case separately.

2. The organizing case of claim 1, and further including a zipper closure mounted on a periphery of the primary panel.

3. The organizing case of claim 1, and further including a mesh pocket mounted to the inner face of the back panel, the mesh pocket capable of holding a plurality of articles.

4. The organizing case of claim 1, and further including a mesh pocket mounted to the inner face of the front panel, the mesh pocket capable of holding a plurality of articles.

5. The organizing case of claim 1, and further including means for making the front and back panels rigid.

6. The organizing case of claim 1, and further including:

at least four elastic bands positioned adjacent to the mirror on the first face of the inner mounting panel, the bands secured to the first face so that each band forms a loop for holding at least one article.

7. The organizing case of claim 1, wherein the inner mounting panel is detachable from the primary panel.

8. The organizing case of claim 1, and further including a pocket assembly selectively located on the outer face of one of the front and back panels.

9. The organizing case of claim 1, and further including stowage means for the removable cover and other items, the stowage means selected from the group consisting of an exterior pocket located on the outer face, an interior pocket located on the inner face, and an interior pocket located in the primary receptacle.

10. The organizing case of claim 1, and further including a detachable shoulder strap configured to be selectively coupled to the organizing case or the removable cover.

11. An organizing case that can be selectively carried inside a purse or as a clutch, the organizing case comprising:

a generally rectangular primary panel having an inner face and an outer face and foldable along a line that is generally parallel to a short side of the rectangle, so that the primary panel forms a front panel and a back panel, and the inner face defines a primary receptacle;

a pocket assembly pivotally mounted to the primary panel and comprising a back pocket panel and a front pocket panel secured together along a bottom and two side edges to form a cavity;

a first inner mounting panel pivotally mounted to the primary panel and having two opposite faces with a mirror mounted on a first face, and a plurality of attachment means mounted on a second face to detachably mount a plurality of items; and a removable cover separable from and normally stowable in the case and configured to envelop the organizing case for carrying the case, wherein the pocket assembly is detachable from the primary panel.

12. An organizing case that can be selectively carried inside a purse or as a clutch, the organizing case comprising:

a generally rectangular primary panel having an inner face and an outer face and foldable along a line that is generally parallel to a short side of the rectangle, so that the primary panel forms a front panel and a back panel, and the inner face defines a primary receptacle;

a pocket assembly pivotally mounted to the primary panel and comprising a back pocket panel and a front pocket panel secured together along a bottom and two side edges to form a cavity;

a first inner mounting panel pivotally mounted to the primary panel and having two opposite faces with a mirror mounted on a first face, and a plurality of attachment means mounted on a second face to detachably mount a plurality of items; and a removable cover separable from and normally stowable in the case and configured to envelop the organizing case for carrying the case separately;

wherein the plurality of attachment means on the second face of the inner mounting panel are selected from the group consisting of:

at least two elastic bands secured to the inner mounting panel with each band forming a plurality of loops; and at least two elastic bands extending transverse and at least two elastic bands extending longitudinally, the bands forming a plurality of loops.

13. An organizing case that can be selectively carried inside a purse or as a clutch, the organizing case comprising:

a generally rectangular primary panel having an inner face and an outer face and foldable along a line that is generally parallel to a short side of the rectangle, so that the primary panel forms a front panel and a back panel, and the inner face defines a primary receptacle;

a pocket assembly pivotally mounted to the primary panel and comprising a back pocket panel and a front pocket panel secured together along a bottom and two side edges to form a cavity;

a first inner mounting panel pivotally mounted to the primary panel and having two opposite faces with a mirror mounted on a first face, and a plurality of attachment means mounted on a second face to detachably mount a plurality of items; and a removable cover separable from and normally stowable in the case and configured to envelop the organizing case for carrying the case separately;

a second inner mounting panel pivotally mounted to the primary panel and having two opposite faces, with a mesh pocket on a first opposite face;

at least two pairs of pockets on a second opposite face, with a first pair of pockets abutting the second face, and a second pair of pockets abutting the first pair of pockets in a staggered relationship; and at least two elastic bands mounted on the second pair of pockets for securing items.

14. The organizing case of claim 13, wherein the second inner mounting panel is detachable from the primary panel.

15. The organizing case of claim 13, and further including:

a third inner mounting panel pivotally mounted to the primary panel and having two opposite faces, with a mesh pocket on a first opposite face; and on the second opposite face a pair of elastic bands extending transverse and a pair of elastic bands extending longitudinally, the elastic bands forming a plurality of loops for holding items.

16. The organizing case of claim 15, wherein the third inner mounting panel is detachable from the primary panel.

17. An organizing case that can be selectively carried inside a purse or as a clutch, the organizing case comprising:

a primary panel of pliable material, the panel being of a generally rectangular configuration having an inner face and an outer face and foldable along a selected line transverse of the primary panel forming a front panel and a back panel defining a primary receptacle;

the back panel having an inner face, a plurality of bands and loops on the inner face for mounting a plurality of articles;

a pocket assembly inside the primary receptacle, the pocket comprising a back pocket panel and a front pocket panel secured together along a bottom and side edges forming a receptacle;

an inner mounting panel pivotally mounted to the primary panel and having a opposite faces, a mirror mounted on one of the faces, and a plurality of attachment means for detachably mounting a plurality of selected personal items on each of the faces; and a removable outer cover for stowing in the organizing case and adapted to cover the case and give it an attractive appearance.

18. The organizing case of claim 17, wherein the pocket assembly is embodied in the back panel.

19. The organizing case of claim 17, wherein the pocket assembly is pivotally mounted substantially on the selected line.

20. The organizing case of claim 17, wherein the primary panel includes a zipper closure along side edges of the primary panel.

21. The organizing case of claim 17, wherein the plurality of attachment means on one face of the inner mounting panel comprises a pair of elastic bands secured along opposite side edges of the one face, each band forming a plurality of loops.

22. The organizing case of claim 17, wherein the plurality of attachment means on the other face of the inner mounting panel comprises a pair of elastic bands secured along opposite side edges of the mirror, each band forming a loop.

23. The organizing case of claim 17, wherein the plurality of bands and loops on the inner face of the back panel comprises a pair of bands extending transverse and a pair of bands extending longitudinally.

24. The organizing case of claim 17, wherein the back panel includes stiffening means and the pocket assembly is incorporated in the back panel.

25. The organizing case of claim 17, wherein the primary panel includes a closure panel on one end thereof, with one of hook and loop fastening means mounted thereon, and the other of hook and loop fastening means on the other end of the primary panel for detachably securing the primary receptacle closed.

26. An organizing case that can be selectively carried inside a purse or as a clutch, the organizing case comprising:

a generally rectangular primary panel having a periphery and a zipper closure mounted on the periphery, the primary panel comprising:

an inner face and an outer face and foldable along a line that is generally parallel to a short side of the rectangle, so that the primary panel forms a front panel and a back panel, and the inner face defines a primary receptacle;

a mesh pocket mounted to both the inner face of the front panel and the inner face of the back panel, the mesh pockets capable of holding a plurality of articles, and a pocket assembly selectively located on the outer face of the front or back panel;

an inner pocket assembly detachably pivotally mounted to the primary panel and comprising a back pocket panel and a front pocket panel secured together along a bottom and two side edges to form a cavity, with a zipper mounted on a top edge for closing the pocket assembly;

a first inner mounting panel detachably pivotally mounted to the primary panel and having two opposite faces;

a mirror mounted on a first opposite face, and four elastic bands positioned adjacent to the mirror so that each band forms a loop;

two elastic bands secured to a second opposite face, with each band forming a plurality of loops;

a second inner mounting panel detachably pivotally mounted to the primary panel and having two opposite faces, with a mesh pocket on a first opposite face;

two pairs of pockets on a second opposite face, with a first pair of pockets abutting the second face, and a second pair of pockets abutting the first pair of pockets in a staggered relationship and at least two elastic bands mounted on the second pair of pockets;

a third inner mounting panel detachably pivotally mounted to the primary panel and having two opposite faces, with a mesh pocket on a first opposite face;

two pairs of elastic bands on a second opposite face, a first pair of elastic bands extending transverse and a second pair of elastic bands extending longitudinally, the elastic bands forming a plurality of loops;

a removable cover stowable in the organizing case, and shaped and configured to envelop the organizing case; and a detachable shoulder strap configured to be coupled to a selected one of the organizing case and to the removable cover.

* * * * *